US008147790B1

(12) United States Patent
Vail et al.

(10) Patent No.: US 8,147,790 B1
(45) Date of Patent: Apr. 3, 2012

(54) METHODS OF FABRICATING POLYCRYSTALLINE DIAMOND BY CARBON PUMPING AND POLYCRYSTALLINE DIAMOND PRODUCTS

(75) Inventors: Michael A. Vail, Genola, UT (US); Kenneth E. Bertagnolli, Riverton, UT (US)

(73) Assignee: US Synthetic Corporation, Orem, UT (US)

( * ) Notice: Subject to any disclaimer, the term of this patent is extended or adjusted under 35 U.S.C. 154(b) by 323 days.

(21) Appl. No.: 12/481,268

(22) Filed: Jun. 9, 2009

(51) Int. Cl.

| | |
|---|---|
| ***E21B 10/36*** | (2006.01) |
| ***B24D 3/02*** | (2006.01) |
| ***B32B 9/00*** | (2006.01) |
| ***B32B 7/02*** | (2006.01) |
| ***B32B 9/04*** | (2006.01) |
| ***B32B 19/00*** | (2006.01) |
| ***B32B 18/00*** | (2006.01) |
| ***G11B 5/64*** | (2006.01) |

(52) U.S. Cl. ..... 423/446; 175/434; 175/433; 175/426; 175/425; 51/307; 428/408; 428/698; 428/212; 428/336; 428/446; 428/325

(58) Field of Classification Search ..... None
See application file for complete search history.

(56) References Cited

U.S. PATENT DOCUMENTS

| | | | |
|---|---|---|---|
| 4,268,276 | A | 5/1981 | Bovenkerk |
| 4,274,900 | A | 6/1981 | Mueller et al. |
| 4,410,054 | A | 10/1983 | Nagel et al. |
| 4,468,138 | A | 8/1984 | Nagel |
| 4,560,014 | A | 12/1985 | Geczy |
| 4,738,322 | A | 4/1988 | Hall et al. |
| 4,811,801 | A | 3/1989 | Salesky et al. |
| 4,913,247 | A | 4/1990 | Jones |
| 5,016,718 | A | 5/1991 | Tandberg |
| 5,092,687 | A | 3/1992 | Hall |
| 5,120,327 | A | 6/1992 | Dennis |
| 5,135,061 | A | 8/1992 | Newton, Jr. |
| 5,154,245 | A | 10/1992 | Waldenstrom et al. |
| 5,180,022 | A | 1/1993 | Brady |
| 5,364,192 | A | 11/1994 | Damm et al. |
| 5,368,398 | A | 11/1994 | Damm et al. |
| 5,460,233 | A | 10/1995 | Meany et al. |

(Continued)

OTHER PUBLICATIONS

A.A. Giardini and J.E. Tydings, Diamond Synthesis: Observations on the Mechanism of Formation, The American Mineralogist, vol. 47, November-December, Jun. 8, 1962, pp. 1394-1420.

(Continued)

*Primary Examiner* — Melvin Mayes
*Assistant Examiner* — Guinever Gregorio
(74) *Attorney, Agent, or Firm* — Workman Nydegger

(57) ABSTRACT

Embodiments of the invention relate to methods of fabricating polycrystalline diamond ("PCD") exhibiting enhanced diamond-to-diamond bonding by carbon pumping, and PCD and polycrystalline diamond compacts formed by such methods. In an embodiment of a method of fabricating PCD, a plurality of diamond crystals and a metal-solvent catalyst may be provided. The diamond crystals and metal-solvent catalyst may be subjected to a first pressure-temperature condition during which carbon is dissolved in the metal-solvent catalyst. After subjecting the diamond crystals and metal-solvent catalyst to the first pressure-temperature condition, the diamond crystals and metal-solvent catalyst may be subjected to a second pressure-temperature condition at which diamond is stable. After subjecting the diamond crystals and the metal-solvent catalyst to the second pressure-temperature condition, the diamond crystals and metal-solvent catalyst may be subjected to a third pressure-temperature condition during which carbon is dissolved in the metal-solvent catalyst.

17 Claims, 7 Drawing Sheets

U.S. PATENT DOCUMENTS

| | | | | |
|---|---|---|---|---|
| 5,480,233 | A | 1/1996 | Cunningham | |
| 5,544,713 | A | 8/1996 | Dennis | |
| 5,849,413 | A * | 12/1998 | Zhu et al. | 428/408 |
| 6,338,754 | B1 | 1/2002 | Cannon et al. | |
| 6,793,681 | B1 | 9/2004 | Pope et al. | |
| 7,635,035 | B1 * | 12/2009 | Bertagnolli et al. | 175/434 |
| 2003/0189114 | A1 * | 10/2003 | Taylor et al. | 239/602 |
| 2004/0146451 | A1 | 7/2004 | Vagarali et al. | |
| 2005/0263328 | A1 * | 12/2005 | Middlemiss | 175/434 |
| 2007/0144790 | A1 * | 6/2007 | Fang et al. | 175/434 |
| 2008/0223621 | A1 * | 9/2008 | Middlemiss et al. | 175/428 |

OTHER PUBLICATIONS

J. Sung, Graphite diamond transition under high pressure: A kinetics approach, Journal of Materials Science 35 (2000) 6041-6054.

Kenneth E. Bertagnolli; U.S. Appl. No. 11/545,929, titled "Superabrasive elements, methods of manufacturing, and drill bits including same" filed Oct. 10, 2006.

* cited by examiner

METHODS OF FABRICATING POLYCRYSTALLINE DIAMOND BY CARBON PUMPING AND POLYCRYSTALLINE DIAMOND PRODUCTS

BACKGROUND

Wear-resistant, polycrystalline diamond compacts ("PDCs") are utilized in a variety of mechanical applications. For example, PDCs are used in drilling tools (e.g., cutting elements, gage trimmers, etc.), machining equipment, bearing apparatuses, wire-drawing machinery, and in other mechanical apparatuses.

PDCs have found particular utility as superabrasive cutting elements in rotary drill bits, such as roller-cone drill bits and fixed-cutter drill bits. A PDC cutting element typically includes a superabrasive diamond layer commonly known as a diamond table. The diamond table is formed and bonded to a substrate using a high-pressure/high-temperature ("HPHT") process. The PDC cutting element may be brazed directly into a preformed pocket, socket, or other receptacle formed in a bit body. The substrate may often be brazed or otherwise joined to an attachment member, such as a cylindrical backing. A rotary drill bit typically includes a number of PDC cutting elements affixed to the bit body. A stud carrying the PDC may also be used as a PDC cutting element when mounted to a bit body of a rotary drill bit by press-fitting, brazing, or otherwise securing the stud into a receptacle formed in the bit body.

Conventional PDCs are normally fabricated by placing a cemented carbide substrate into a container with a volume of diamond crystals positioned on a surface of the cemented-carbide substrate. A number of such containers may be loaded into a HPHT press. The substrate(s) and volume of diamond crystals are then processed at HPHT conditions in the presence of a metal-solvent catalyst that causes the diamond crystals to bond to one another to form a matrix of bonded diamond crystals defining a polycrystalline diamond ("PCD") table. The metal-solvent catalyst is often made from cobalt, nickel, iron, or alloys thereof, and used for promoting intergrowth of the diamond crystals.

In one conventional approach, a constituent of the cemented carbide substrate, such as cobalt from a cobalt-cemented tungsten carbide substrate, liquefies and sweeps from a region adjacent to the volume of diamond crystals into interstitial regions between the diamond crystals during the HPHT process. The cobalt acts as a catalyst to promote intergrowth between the diamond crystals, which results in formation of bonded diamond crystals. Sometimes, a metal-solvent catalyst may be mixed with the diamond crystals prior to subjecting the diamond crystals and substrate to the HPHT process.

During the HPHT process, the metal-solvent catalyst dissolves carbon from the diamond crystals, carbon from portions of the diamond crystals that graphitize during the HPHT process, carbon swept-in with metal-solvent catalyst infiltrated from the cemented carbide substrate, or combinations thereof. The solubility of diamond in the metal-solvent catalyst is lower than that of the metastable graphite under diamond-stable HPHT conditions. Undersaturated graphite tends to dissolve into the metal-solvent catalyst and supersaturated diamond tends to deposit on and/or grow between existing diamond crystals to form a matrix of bonded-together diamond crystals with diamond-to-diamond bonding therebetween.

SUMMARY

Embodiments of the invention relate to methods of fabricating PCD exhibiting enhanced diamond-to-diamond bonding by carbon pumping, and PCD and PDCs formed by such methods. In an embodiment of a method of fabricating PCD, a plurality of diamond crystals and a metal-solvent catalyst may be provided. The diamond crystals and the metal-solvent catalyst may be subjected to a first pressure-temperature condition during which carbon is dissolved in the metal-solvent catalyst. After subjecting the diamond crystals and the metal-solvent catalyst to the first pressure-temperature condition, the diamond crystals and the metal-solvent catalyst may be subjected to a second pressure-temperature condition at which diamond is stable. Carbon has a lower solubility in the metal-solvent catalyst at the second pressure-temperature condition than at the first pressure-temperature condition. After subjecting the diamond crystals and the metal-solvent catalyst to the second pressure-temperature condition, the diamond crystals and the metal-solvent catalyst may be subjected to a third pressure-temperature condition during which carbon is dissolved in the metal-solvent catalyst.

Other embodiments include PCD and PDCs formed by the above-described methods, and applications utilizing such PCD and PDCs in various articles and apparatuses, such as rotary drill bits, bearing apparatuses, wire-drawing dies, machining equipment, and other articles and apparatuses.

Features from any of the disclosed embodiments may be used in combination with one another, without limitation. In addition, other features and advantages of the present disclosure will become apparent to those of ordinary skill in the art through consideration of the following detailed description and the accompanying drawings.

BRIEF DESCRIPTION OF THE DRAWINGS

The drawings illustrate several embodiments of the invention, wherein identical reference numerals refer to identical elements or features in different views or embodiments shown in the drawings.

DETAILED DESCRIPTION

Embodiments of the invention relate to methods of fabricating PCD exhibiting enhanced diamond-to-diamond bonding by carbon pumping, and PCD and PDCs formed by such methods. The PCD and PDCs disclosed herein may be used in a variety of applications, such as rotary drill bits, bearing apparatuses, wire-drawing dies, machining equipment, and other articles and apparatuses.

Carbon pumping is a technique employed in an HPHT process used to fabricate PCD that includes subjecting a plurality of diamond crystals, in the presence of a metal-solvent catalyst, to at least two different HPHT conditions to facilitate diamond-to-diamond bonding between the diamond crystals. For example, carbon pumping may include subjecting a plurality of diamond crystals, in the presence of a metal-solvent catalyst, to at least one carbon-dissolving pressure-temperature condition at which the metal-solvent catalyst is approximately saturated with carbon and at least one diamond-stable pressure-temperature condition at which the carbon in the metal-solvent catalyst forms as diamond between and/or upon existing diamond crystals due to the solubility of carbon in the metal-solvent catalyst being less than at the at least one carbon-dissolving pressure-temperature condition. In some embodiments, the at least one carbon-dissolving pressure-temperature condition may be a diamond-stable pressure-temperature condition or a graphite-stable pressure-temperature condition.

Figure 1:
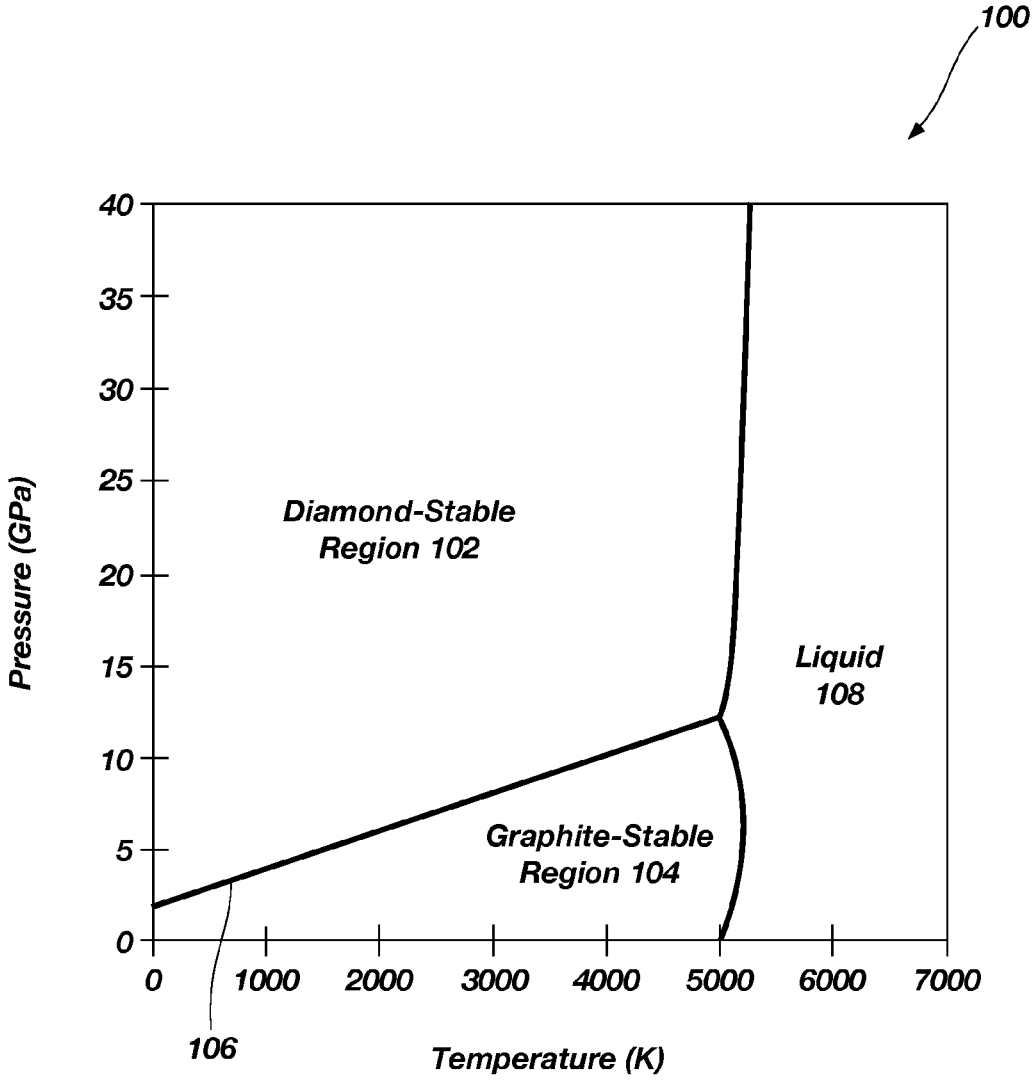
FIG. 1 is an equilibrium pressure-temperature phase diagram for carbon.

Referring to FIG. 1, in order to facilitate understanding of the various embodiments of the invention, a brief description of an equilibrium pressure-temperature phase diagram 100 for carbon is provided. At equilibrium, when carbon is subjected to a pressure-temperature condition (P, T) that falls within a diamond-stable region 102, the carbon will be in the form of the diamond phase. A pressure-temperature condition (P, T) is a particular pressure (P) and a particular temperature (T) that defines a point on the phase diagram 100 shown in FIG. 1. At equilibrium, when carbon is subjected to a pressure-temperature condition (P, T) that falls within a graphite-stable region 104 of the phase diagram 100, the carbon will be in the form of the graphite phase. An equilibrium line 106 of the equilibrium pressure-temperature phase diagram 100 defines pressure-temperature conditions (P, T) at which the diamond phase and the graphite phase are in equilibrium with each other. The diamond and graphite phases are in equilibrium with each other at any pressure-temperature condition (P, T) along the equilibrium line 106. Carbon will be present as a liquid phase at any pressure-temperature condition (P, T) in a liquid region 108.

Figure 2:
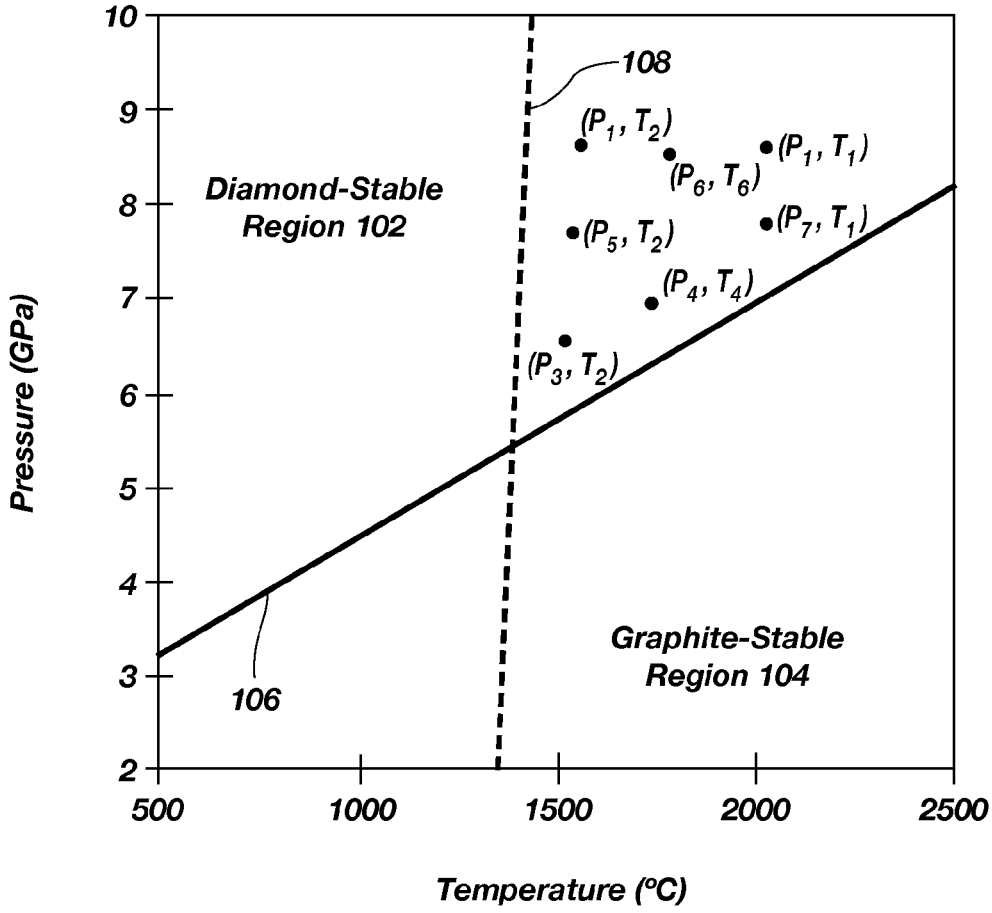
FIG. 2 is an HPHT process diagram, of various embodiments of methods for fabricating PCD, superimposed on an enlarged section of the phase diagram of FIG. 1.

FIG. 2 is an HPHT process diagram, of various embodiments of methods for fabricating PCD, superimposed on an enlarged section of the phase diagram 100 of FIG. 1. The HPHT process includes alternating between subjecting a plurality of diamond crystals in the presence of a metal-solvent catalyst to at least one carbon-dissolving pressure-temperature condition at which the metal-solvent catalyst is approximately saturated with carbon and at least one diamond-stable pressure-temperature condition at which the carbon in the metal-solvent catalyst forms as diamond between existing diamond crystals. Such diamond formation may occur due to carbon having a lower solubility in the metal-solvent catalyst than at the at least one diamond-stable pressure-temperature condition. In such an embodiment, carbon provided from graphite particles mixed with the diamond crystals; graphite formed by graphitizing outer portions of the diamond crystals during the HPHT process; carbon provided from an outer non-diamond shell of ultra-dispersed diamond particles; carbon provided from another non-diamond carbon source that exhibits at least partial $sp^2$ bonding (e.g., fullerenes); and/or carbon provided from the diamond crystals may dissolve into the liquefied metal-solvent catalyst at the carbon-dissolving pressure-temperature condition until the solubility limit of carbon in the metal-solvent catalyst is approximately reached and diamond is formed at the at least one diamond-stable pressure-temperature condition so that a matrix of directly bonded-together diamond crystals may be formed. By repeatedly dissolving carbon into the metal-solvent catalyst and converting at least some of the dissolved carbon to diamond, the density of diamond-to-diamond bonding in the PCD so-formed may be increased compared to if the diamond crystals are sintered at a single diamond-stable pressure-temperature condition.

With continuing reference to FIG. 2, the various embodiments of methods for fabricating the PCD are now described in more detail below. A plurality of diamond crystals and a metal-solvent catalyst may be provided. In an embodiment, a non-diamond carbon source may be mixed with the diamond crystals. For example, suitable non-diamond carbon sources include, but are not limited to, graphite particles, fullerenes, or combinations thereof mixed with the diamond crystals using any suitable mixing process. The graphite particles may be crystalline graphite particles, amorphous graphite particles, synthetic graphite particles, or combinations thereof. The term "amorphous graphite" refers to naturally occurring microcrystalline graphite. Crystalline graphite particles may be naturally occurring or synthetic. Various types of graphite particles are commercially available from Ashbury Graphite Mills of Kittanning, Pa. The non-diamond carbon source may comprise about 0.1 to about 10 percent by weight of a mixture of the non-diamond carbon source and the diamond crystals, such as about 4 to about 6 percent by weight.

As an alternative to or in addition to the aforementioned non-diamond carbon sources, ultra-dispersed diamond particles may be mixed with the diamond crystals and, if present, the non-diamond carbon source. An ultra-dispersed diamond particle (also commonly known as a nanocrystalline diamond particle) is a particle generally composed of a PCD core surrounded by a metastable carbon shell. Such ultra-dispersed diamond particles may exhibit a particle size of about 1 nm to about 50 nm and, more typically, of about 2 nm to about 20 nm. Agglomerates of ultra-dispersed diamond particles may be between about 2 nm to about 200 nm. Ultra-dispersed diamond particles may be formed by detonating trinitrotoluene explosives in a chamber and subsequent purification to extract diamond particles or agglomerates of diamond particles with the diamond particles generally composed of a PCD core surrounded by a metastable shell that includes amorphous carbon and/or carbon onion (i.e., closed shell $sp^2$ nanocarbons). Ultra-dispersed diamond particles are commercially available from ALIT Inc. of Kiev, Ukraine. The metastable shells of the ultra-dispersed diamond particles may serve as a non-diamond carbon source.

The plurality of diamond crystals may exhibit one or more selected sizes. The one or more selected sizes may be determined, for example, by passing the diamond crystals through one or more sizing sieves or by any other method. In an embodiment, the plurality of diamond crystals may include a relatively larger size and at least one relatively smaller size. As used herein, the phrases "relatively larger" and "relatively smaller" refer to particle sizes determined by any suitable method, which differ by at least a factor of two (e.g., 40 μm and 20 μm). More particularly, in various embodiments, the plurality of diamond crystals may include a portion exhibiting a relatively larger size (e.g., 100 μm, 90 μm, 80 μm, 70 μm, 60 μm, 50 μm, 40 μm, 30 μm, 20 μm, 15 μm, 12 μm, 10 μm, 8 μm) and another portion exhibiting at least one relatively smaller size (e.g., 30 μm, 20 μm, 10 μm, 15 μm, 12 μm, 10 μm, 8 μm, 4 μm, 2 μm, 1 μm, 0.5 μm, less than 0.5 μm, 0.1 μm, less than 0.1 μm). In another embodiment, the plurality of diamond crystals may include a portion exhibiting a relatively larger size between about 40 μm and about 15 μm and another portion exhibiting a relatively smaller size between about 12 μm and 2 μm. Of course, the plurality of diamond crystals may also comprise three or more different sizes (e.g., one relatively larger size and two or more relatively smaller sizes), without limitation.

Suitable metal-solvent catalysts include, but are not limited to, iron, nickel, cobalt, or alloys of any of the foregoing metals. The metal-solvent catalyst may be provided in particulate form and mixed with the diamond crystals and, if present, the non-diamond carbon source; provided as a thin foil or plate placed adjacent to the diamond crystals; provided from a cemented carbide substrate including the metal-solvent catalyst as a cementing constituent; or combinations of the foregoing.

The diamond crystals and, if present, the non-diamond carbon source are subjected to an HPHT process in the presence of the metal-solvent catalyst to sinter the diamond crystals and form PCD. In order to efficiently sinter the diamond crystals, the diamond crystals, the metal-solvent catalyst, and, if present, the non-diamond carbon source may be enclosed in a pressure transmitting medium, such as a refractory metal can embedded in pyrophyllite or other pressure transmitting medium to form a cell assembly. Examples of suitable gasket materials and cell structures for use in manufacturing PCD are disclosed in U.S. Pat. No. 6,338,754 and U.S. patent application Ser. No. 11/545,929, each of which is incorporated herein, in its entirety, by this reference. Suitable pyrophyllite materials are commercially available from Wonderstone Ltd. of South Africa. One or more heating elements may be embedded in and/or surround the pressure transmitting medium to allow for controllably heating of the diamond crystals, the metal-solvent catalyst, and, if present, the non-diamond carbon source enclosed therein. Selected HPHT conditions may be imposed on the diamond crystals, the metal-solvent catalyst, and, if present, the non-diamond carbon source by applying a selected pressure to the pressure transmitting medium in an ultra-high pressure press, while simultaneously controlling temperature using the one or more heating elements.

Still referring to FIG. 2, during the HPHT process, the diamond crystals, the metal-solvent catalyst, and, if present, the non-diamond carbon source enclosed in the pressure transmitting medium may be subjected to a first diamond-stable pressure-temperature condition ($P_1$, $T_1$) within the diamond-stable region 102 at which diamond is stable and the metal-solvent catalyst is liquefied. The temperature ($T_1$) of the first diamond-stable pressure-temperature condition ($P_1$, $T_1$) may be selected to be above the eutectic temperature line 108 for the metal-solvent catalyst/carbon system at the pressure ($P_1$). The eutectic temperature line 108 is the eutectic temperature for the metal-solvent catalyst/carbon system as a function of pressure. The illustrated eutectic temperature line 108 is for the cobalt-carbon system, and it is noted that the eutectic temperature line for other metal-solvent catalysts (e.g., nickel, iron, or alloys thereof) will be different. The pressure ($P_1$) of the first diamond-stable pressure-temperature condition ($P_1$, $T_1$) may range from about 5.5 GPa at a corresponding temperature ($T_1$) of about 1400° C. to about 1600° C. to about 8 GPa at a corresponding temperature ($T_1$) of about 2000° C. to about 2500° C. The first diamond-stable pressure-temperature condition ($P_1$, $T_1$) may be maintained for a time sufficient so that the carbon from diamond crystals and, if present, from the non-diamond carbon source dissolves into the liquefied metal-solvent catalyst until the solubility limit of carbon in the metal-solvent catalyst is approximately reached. Graphite, fullerenes, or other non-diamond carbon sources that exhibit at least partial $sp^2$ bonding may have a higher solubility in the liquefied metal-solvent catalyst than diamond and, thus, may dissolve to a greater extent in the liquefied metal-solvent catalyst at the first diamond-stable pressure-temperature condition (P, $T_1$) than the diamond crystals.

Then, the temperature and/or pressure of the HPHT process may be decreased so that the diamond crystals, the metal-solvent catalyst, and, if present, the non-diamond carbon source are subjected to a second diamond-stable pressure-temperature condition ($P_1$, $T_2$), ($P_3$, $T_2$), ($P_4$, $T_4$), ($P_5$, $T_2$), ($P_6$, $T_6$), or ($P_7$, $T_1$) within the diamond-stable region 102 at which diamond is stable and the metal-solvent catalyst is still at least partially liquefied. For example, in an embodiment, the pressure may be maintained substantially constant at the pressure ($P_1$), while the temperature is decreased to impose the pressure-temperature conditions ($P_1$, $T_2$). However, other embodiments, the pressure and/or temperature may be varied to impose pressure-temperature conditions of, for example, any of ($P_3$, $T_2$), ($P_4$, $T_4$), ($P_5$, $T_2$), ($P_6$, $T_6$), or ($P_7$, $T_1$). As will be discussed in further detail hereinbelow, in other embodiments, any of ($P_3$, $T_2$), ($P_4$, $T_4$), ($P_5$, $T_2$), ($P_6$, $T_6$), or ($P_7$, $T_1$) pressure-temperature conditions may also fall on the equilibrium line 106 between the diamond-stable region 102 and the graphite-stable region 104.

At the second diamond-stable pressure-temperature condition, carbon dissolved in the liquefied metal-solvent catalyst forms diamond between and/or upon existing diamond crystals due, at least in part, to a reduced solubility for carbon. For example, when the pressure of the second diamond-stable pressure-temperature condition is about 5.5 GPa, the temperature of the second diamond-stable pressure-temperature condition may range from about 1400° C. to about 1480° C. As another example, when the pressure of the second diamond-stable pressure-temperature condition is about 7-8 GPa, the temperature of the second diamond-stable pressure-temperature condition may range from about 1400° C. to about 1700° C. The second diamond-stable pressure-temperature condition may be maintained for a time sufficient to at least partially sinter the diamond crystals together and form a matrix of PCD comprising a matrix of directly bonded-together diamond crystals, with the liquefied metal-solvent catalyst disposed interstitially between the diamond crystals. In some embodiments, the temperature of the second diamond-stable pressure-temperature condition may be less than eutectic temperature for the metal-solvent catalyst/carbon system and the metal-solvent catalyst may be partially melted or exhibit an insubstantial amount of liquid phase (e.g., being substantially solid). It is noted that some diamond may also be formed at the previous first diamond-stable pressure-temperature condition ($P_1$, $T_1$) and, thus, the diamond crystals may be at least partially sintered prior to subjection to the second diamond-stable pressure-temperature condition.

Next, the temperature and/or pressure of the HPHT process may be increased so that the matrix, the metal-solvent catalyst, and, if present, the non-diamond carbon source may be subjected to a third diamond-stable pressure-temperature condition. For example, the third diamond-stable pressure-temperature condition may be the same as the first diamond-stable pressure-temperature condition ($P_1$, $T_1$) or another diamond-stable pressure-temperature condition within the diamond-stable region 102 at which carbon has a higher solubility in the metal-solvent catalyst than at the second diamond-stable pressure-temperature condition. The third diamond-stable pressure-temperature condition may be maintained for a time sufficient so that the carbon from the diamond crystals and, if present, from the remaining non-diamond carbon source dissolves into the liquefied metal-solvent catalyst until the solubility limit of carbon in the metal-solvent catalyst is approximately reached.

Then, the temperature and/or pressure of the HPHT process may be decreased so that the matrix, the metal-solvent catalyst, and, if present, the non-diamond carbon are subjected to a fourth diamond-stable pressure-temperature condition. For example, the fourth diamond-stable pressure-temperature condition may be the same as the second diamond-stable pressure-temperature condition or another suitable diamond-stable pressure-temperature condition in which carbon has a lower solubility in the metal-solvent catalyst than at the third diamond-stable pressure-temperature condition. At the fourth diamond-stable pressure-temperature condition, diamond is stable and the dissolved carbon in the at least partially liquefied metal-solvent catalyst forms diamond between and/or upon existing diamond crystals to increase the density of diamond-to-diamond bonding in the matrix of PCD. The fourth diamond-stable pressure-temperature condition may be maintained for a time sufficient so that excess dissolved carbon in the liquefied metal-solvent catalyst forms as diamond.

The above-described carbon pumping process in which carbon from the diamond crystals and/or the non-diamond carbon source is dissolved into the liquefied metal-solvent catalyst at a first diamond-stable pressure-temperature condition and diamond is formed at another diamond-stable pressure-temperature condition may be repeated until a desired amount of diamond-to-diamond bond density is achieved between bonded diamond crystals, until substantially all of the non-diamond carbon source (if present) is dissolved and excess carbon forms as diamond, or both. The number of carbon pumping cycles may be dependent on the relative amounts of non-diamond carbon available and the metal-solvent catalyst and/or the desired amount of diamond-to-diamond bonding. The PCD so-formed includes a matrix of directly bonded-together diamond crystals (i.e., diamond-to-diamond bonding) defining interstitial regions, with the metal-solvent catalyst disposed in the interstitial regions.

The PCD so-formed may exhibit several characteristic mechanical and/or thermal properties. For example, the density of diamond-to-diamond bonding exhibited by the PCD so-formed may be increased compared to if the diamond crystals are sintered at a single diamond-stable pressure-temperature condition without using a carbon pumping process. Because the PCD so-formed exhibits a relatively high diamond-to-diamond bond density, wear resistance, thermal stability, density (e.g., at least about 95 percent theoretical density), and other mechanical characteristics may be enhanced.

Figure 3:
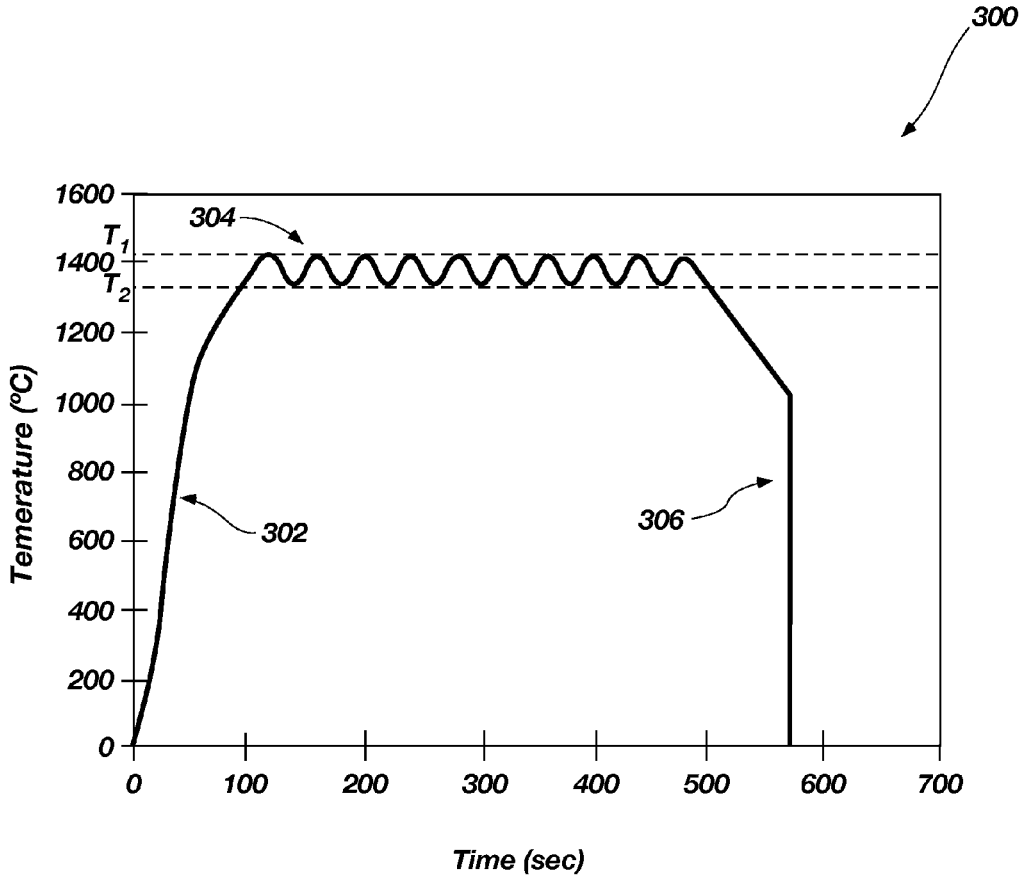
FIG. 3 is a graph of an embodiment of a temperature-time cycle that may be used in one or more of the HPHT processes shown in FIG. 2 to cycle between a first diamond-stable pressure-temperature condition and a second diamond-stable pressure-temperature condition.

FIG. 3 is a graph of an embodiment of a temperature-time cycle 300 that may be used in one or more of the HPHT processes shown in FIG. 2 to cycle between the first diamond-stable pressure-temperature condition ($P_1$, $T_1$) and a second diamond-stable pressure-temperature condition, such as the second diamond-stable pressure-temperature condition ($P_1$, $T_2$). The temperature-time cycle 300 includes a temperature ramp-up region 302 in which the temperature is gradually increased to the temperature ($T_1$) while under sufficient pressure so that diamond-stable conditions may be maintained. Then, the temperature of the HPHT process may be continuously cycled in a cyclic region 304 between the temperature ($T_1$) to impose the first diamond-stable pressure-temperature condition ($P_1$, $T_1$) and the temperature ($T_2$) to impose the second diamond-stable pressure-temperature condition ($P_1$, $T_2$) while the pressure is maintained substantially constant at a pressure ($P_1$). After a desired number of cycles, the temperature may be gradually ramped down from the temperature ($T_1$) as represented by ramp-down region 306.

In another embodiment, the temperature-time cycle may be a saw-tooth type of cycle. In such an embodiment, the temperature may be linearly decreased from the temperature ($T_2$) to the temperature ($T_1$) and linearly increased from the temperature ($T_1$) to the temperature ($T_2$).

In some of the embodiments described with respect to FIGS. 2 and 3, the pressure may be maintained substantially constant, while the temperature of the HPHT process is repeatedly switched between the temperature ($T_1$) at which carbon is more soluble in the metal-solvent catalyst and the temperature ($T_2$) at which carbon is less soluble in the metal-solvent catalyst. However, in other embodiments, the temperature of the HPHT process may be maintained substantially constant, while the pressure of the HPHT process is alternated between a first pressure at which carbon is more soluble in the liquefied metal-solvent catalyst and a second lower pressure at which carbon is less soluble in the liquefied metal-solvent catalyst. For example, the temperature of the HPHT process may be maintained substantially constant at about 1450° C. to about 2200° C., with the pressure of the HPHT process switched between a corresponding pressure in the diamond-stable region 102 at which the metal-solvent catalyst is saturated with carbon and a corresponding pressure in the diamond-stable region 102 near the equilibrium line 106 at which diamond is formed.

In the illustrated embodiments of the HPHT processes shown in FIGS. 2 and 3, the pressure-temperature conditions ($P_1$, $T_2$), ($P_3$, $T_2$), ($P_4$, $T_4$), ($P_5$, $T_2$), ($P_6$, $T_6$), or ($P_7$, $T_1$) at which carbon is dissolved into the metal-solvent catalyst are within the diamond-stable region 102. However, in other embodiments, at least one of the first or third pressure-temperature conditions may be selected to be at the equilibrium line 106 or within the graphite-stable region 104 at which carbon has a higher solubility in the metal-solvent catalyst. In such an embodiment, the diamond crystals may be partially graphitized and carbon from the partially graphitized diamond crystals, the un-graphitized diamond, and, if present, the non-carbon diamond source may dissolve in the liquefied metal-solvent catalyst. Such dissolved carbon may form diamond between existing diamond crystals, as previously described, at a diamond-stable pressure-temperature condition such as the second and fourth diamond-stable pressure-temperature condition at which carbon has a lower solubility in the metal-solvent catalyst.

Figure 4:
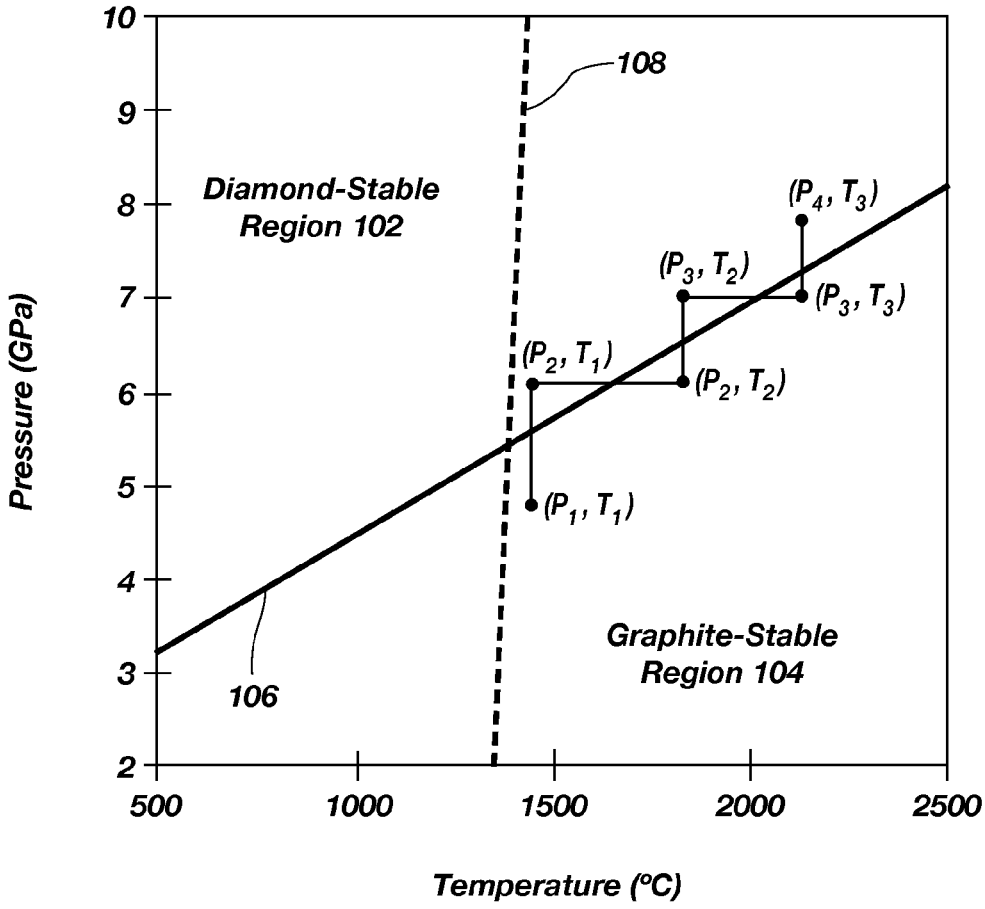
FIG. 4 is an HPHT process diagram of another embodiment of a method for fabricating PCD superimposed on an enlarged section of the phase diagram of FIG. 1.

FIG. 4 is an HPHT process diagram of another embodiment of a method for fabricating PCD superimposed on an enlarged section the phase diagram of FIG. 1. The HPHT process includes alternating between subjecting the diamond crystals in the presence of a metal-solvent catalyst to a unique graphite-stable pressure-temperature condition and a unique diamond-stable pressure-temperature condition. Referring to FIG. 4, during an HPHT process, the diamond crystals, the metal-solvent catalyst, and, if present, the non-diamond carbon source enclosed in the pressure transmitting medium may be subjected to a graphite-stable pressure-temperature condition ($P_1$, $T_1$) within the graphite-stable region 104 at which graphite is stable and the metal-solvent catalyst is liquefied. At the graphite-stable pressure-temperature condition ($P_1$, $T_1$), the diamond crystals may be partially graphitized. The graphite-stable pressure-temperature condition ($P_1$, $T_1$) may be maintained for a time sufficient so that the carbon from the partially graphitized diamond crystals and, if present, carbon from the non-diamond carbon source dissolves into the liquefied metal-solvent catalyst until the solubility limit of carbon in the metal-solvent catalyst is approximately reached.

Next, the pressure of the HPHT process may be increased so that the diamond crystals, the metal-solvent catalyst, and, if present, the non-diamond carbon are subjected to a diamond-stable pressure-temperature condition ($P_2$, $T_1$). At the diamond-stable pressure-temperature condition ($P_2$, $T_1$), diamond is stable and the dissolved carbon in the liquefied metal-solvent catalyst forms diamond between and/or upon the diamond crystals to at least partially sinter the diamond crystals and form a matrix comprising directly-bonded-together diamond crystals, with the liquefied metal-solvent catalyst disposed interstitially between the diamond crystals. The diamond-stable pressure-temperature condition ($P_2$, $T_1$) may be maintained for a time sufficient so that excess dissolved carbon in the liquefied metal-solvent catalyst forms diamond.

Then, the temperature of the HPHT process may be increased so that the matrix, the metal-solvent catalyst, and, if present, the non-diamond carbon source are subjected to a unique graphite-stable pressure-temperature condition ($P_2$, $T_2$) within the graphite-stable region 104 at which graphite is stable and the metal-solvent catalyst is still liquefied. At the graphite-stable pressure-temperature condition ($P_2$, $T_2$), the diamond crystals of the matrix may be partially graphitized. The graphite-stable pressure-temperature condition ($P_2$, $T_2$) may be maintained for a time sufficient so that the carbon from the partially graphitized diamond crystals and, if present, carbon from the remaining non-diamond carbon source dissolves into the liquefied metal-solvent catalyst until the solubility limit of carbon in the metal-solvent catalyst is approximately reached.

Next, the pressure of the HPHT process may be increased so that the matrix, the metal-solvent catalyst, and, if present, the non-diamond carbon are subjected to a unique diamond-stable pressure-temperature condition ($P_3$, $T_2$). At the diamond-stable pressure-temperature condition ($P_3$, $T_2$), diamond is stable and the dissolved carbon in the liquefied metal-solvent catalyst forms diamond between and/or upon existing diamond crystals to increase the density of diamond-to-diamond bonding in the matrix. The diamond-stable pressure-temperature condition ($P_3$, $T_2$) may be maintained for a time sufficient so that excess dissolved carbon in the liquefied metal-solvent catalyst forms diamond.

The carbon pumping process in which carbon from partially graphitized diamond crystals and, if present, the non-diamond carbon source is dissolved into the liquefied metal-solvent catalyst at a graphite-stable pressure-temperature condition and diamond is formed at a diamond-stable pressure-temperature condition may be repeated until a desired amount of diamond-to-diamond bond density is achieved between bonded diamond crystals. For example, following diamond formation at the diamond-stable pressure-temperature condition ($P_3$, $T_2$), the temperature of the HPHT process may be increased so that the HPHT process conditions are at a unique graphite-stable pressure-temperature condition ($P_3$, $T_3$) to dissolve carbon into the liquefied metal-solvent catalyst from partially graphitized diamond crystals and, if present, the remaining non-diamond carbon source. Then, the pressure of the HPHT process may be increased so that the matrix, the metal-solvent catalyst, and, if present, the non-diamond carbon are subjected to a third diamond-stable pressure-temperature condition ($P_4$, $T_3$) to form diamond. This process may be repeated until a desired diamond-to-diamond bond density is achieved in the matrix, until substantially all of the non-diamond carbon source (if present) is dissolved and formed as diamond, or both. The number of carbon pumping cycles may be dependent on the relative amount of non-diamond carbon mixed with the diamond crystals and the metal-solvent catalyst.

In the illustrated embodiment shown in FIG. 4, the transition between a graphite-stable pressure-temperature condition and a diamond-stable pressure-temperature condition is effected by increasing the pressure without substantially changing the temperature and the transition between a diamond-stable pressure-temperature condition and a graphite-stable pressure-temperature condition is effected by increasing the temperature without substantially changing the pressure. However, in other embodiments, the transition between a graphite-stable pressure-temperature condition and a diamond-stable pressure-temperature condition may be effected by increasing the pressure and decreasing the temperature or just decreasing the temperature, and the transition between a diamond-stable pressure-temperature condition and a graphite-stable pressure-temperature condition may be effected by increasing the temperature and decreasing the pressure or just decreasing the pressure.

In the illustrated embodiment shown in FIG. 4, the pressure-temperature conditions ($P_1$, $T_1$), ($P_2$, $T_2$), and ($P_3$, $T_3$) are in the graphite-stable region 104. However, in other embodiments, one or more of the pressure-temperature conditions ($P_1$, $T_1$), ($P_2$, $T_2$), or ($P_3$, $T_3$) may be lie upon the equilibrium line 106 or within the diamond-stable region 102.

Figure 5:
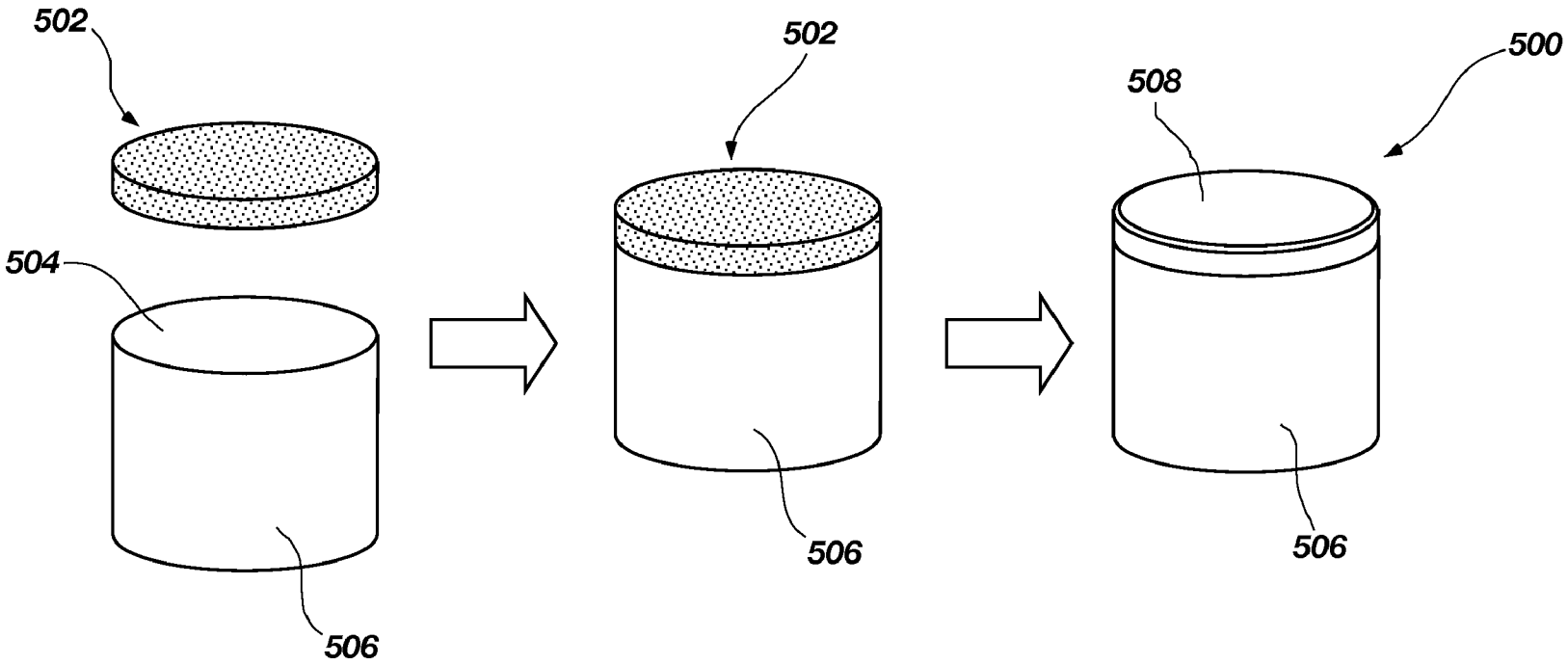
FIG. 5 is a schematic illustration of an embodiment of a method for fabricating a PDC.

FIG. 5 is a schematic illustration of an embodiment of method for fabricating a PDC 500. Referring to FIG. 5, at least one layer 502 may be positioned adjacent to an interfacial surface 504 of a substrate 506. The at least one layer 502 includes a plurality of diamond crystals having any of the aforementioned diamond particle size distributions and, in some embodiments, a non-diamond carbon source (e.g., graphite particles, fullerenes, or combinations thereof) and/or ultra-dispersed diamond particles mixed with the diamond crystals. The substrate 506 may include a metal-solvent catalyst that serves to catalyze formation of PCD from the diamond crystals of the at least one layer 502. For example, the substrate 506 may include, without limitation, cemented carbides, such as tungsten carbide, titanium carbide, chromium carbide, niobium carbide, tantalum carbide, vanadium carbide, or combinations thereof cemented with iron, nickel, cobalt, or alloys thereof. For example, in one embodiment, the substrate 506 comprises cobalt-cemented tungsten carbide. Although the interfacial surface 504 of the substrate 506 is depicted in FIG. 5 as being substantially planar, the interfacial surface 504 may exhibit a selected non-planar topography.

Still referring to FIG. 5, the at least one layer 502 and the substrate 506 may be subjected to any of the disclosed carbon pumping HPHT processes, such as the HPHT processes previously described with respect to the methods illustrated in FIGS. 1-4. The PDC 500 so-formed includes a PCD table 508 integrally formed with and bonded to the interfacial surface 504 of the substrate 506. The PCD forming the PCD table 508 may exhibit the same or similar structure as the PCD described with respect to the PCD formed according to the methods illustrated in FIGS. 1-4. If the substrate 506 includes a metal-solvent catalyst (e.g., cobalt in a cobalt-cemented tungsten carbide substrate), the metal-solvent catalyst may liquefy and infiltrate into the at least one layer 502 during the HPHT process to promote intergrowth between adjacent diamond crystals of the at least one layer 502 and formation of PCD. Further, when the substrate 506 includes a metal-solvent catalyst (e.g., cobalt) and carbide particles (e.g., tungsten carbide particles), the liquefied metal-solvent catalyst may carry carbon and/or a carbide (e.g., tungsten carbide) that may be dissolved therein and/or carried from the substrate 506 that may also serve as a non-diamond carbon source. Upon cooling from the HPHT process, a strong metallurgical bond is formed between the interfacial surface 504 and the PCD table 508 due to the infiltration of the metal-solvent catalyst from the substrate 506.

In an embodiment, the metal-solvent catalyst may also be provided from an intermediate layer disposed between the at least one layer 502 and the substrate 506. The intermediate layer may include any of the aforementioned metal-solvent catalysts. For example, the intermediate layer may include a plurality of metal-solvent catalyst particles, or a thin foil or plate made from the metal-solvent catalyst.

In other embodiments, the PCD table 508 may be separately formed using a HPHT process as described with respect to the methods illustrated in FIGS. 1-4 and, subsequently, bonded to the interfacial surface 504 of the substrate 506 by brazing, using a separate HPHT bonding process, or another suitable joining technique, without limitation. In yet another embodiment, the substrate 506 may be formed by depositing a binderless carbide (e.g., tungsten carbide) via chemical vapor deposition onto the separately formed PCD table.

In an embodiment, the PCD table 508 may be leached to a selected depth after formation on the substrate 506 via an acid-leaching process. In another embodiment, the PCD table 508 may be leached to remove substantially all of the metal-solvent catalyst therefrom and the leached PCD table so-formed may be joined to second substrate in a separate HPHT process. After joining the leached PCD table to the second substrate, the PCD table may be subjected to a second leaching process to at least partially remove an infiltrant infiltrated from the second substrate, if desired.

Figure 6:
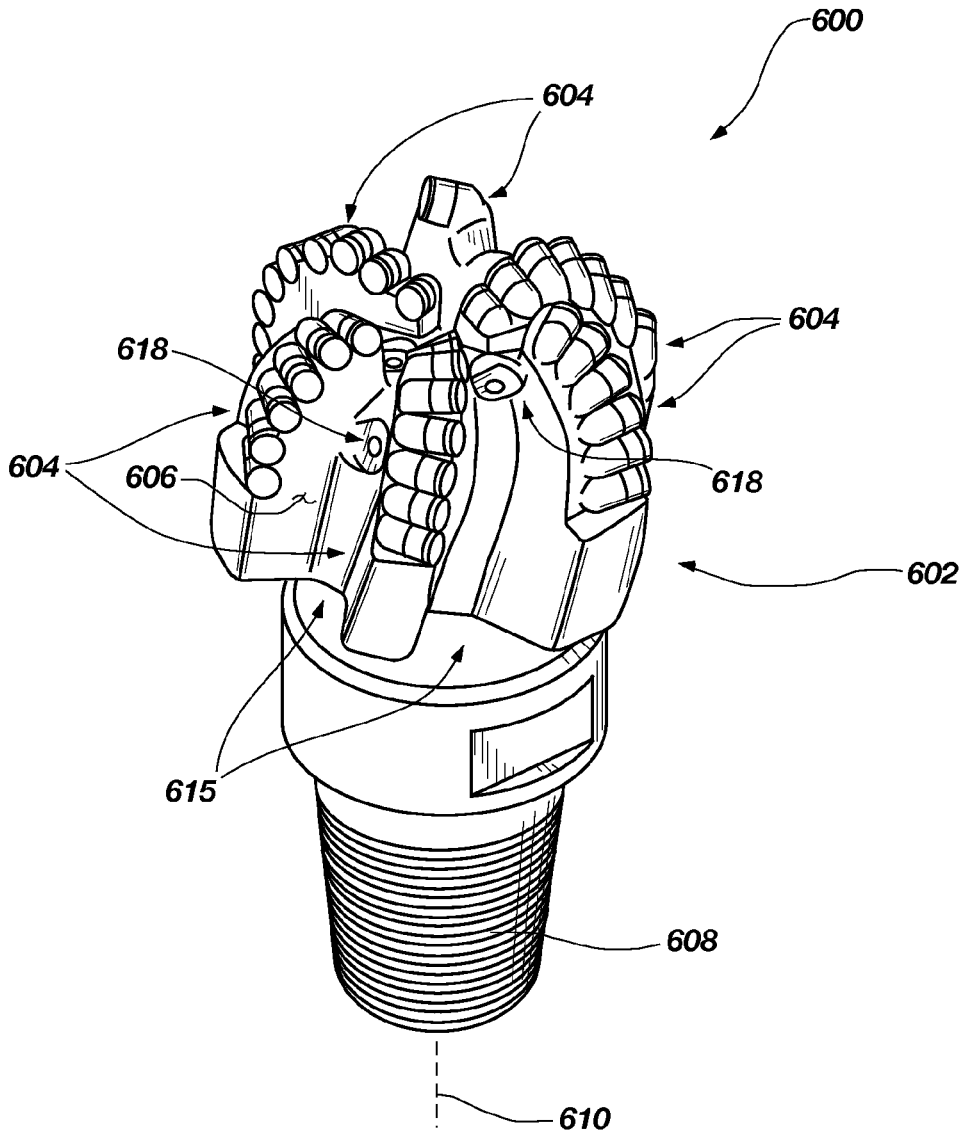
FIG. 6 is an isometric view of an embodiment of a rotary drill bit that may employ one or more of the disclosed PDC embodiments.
Figure 7:
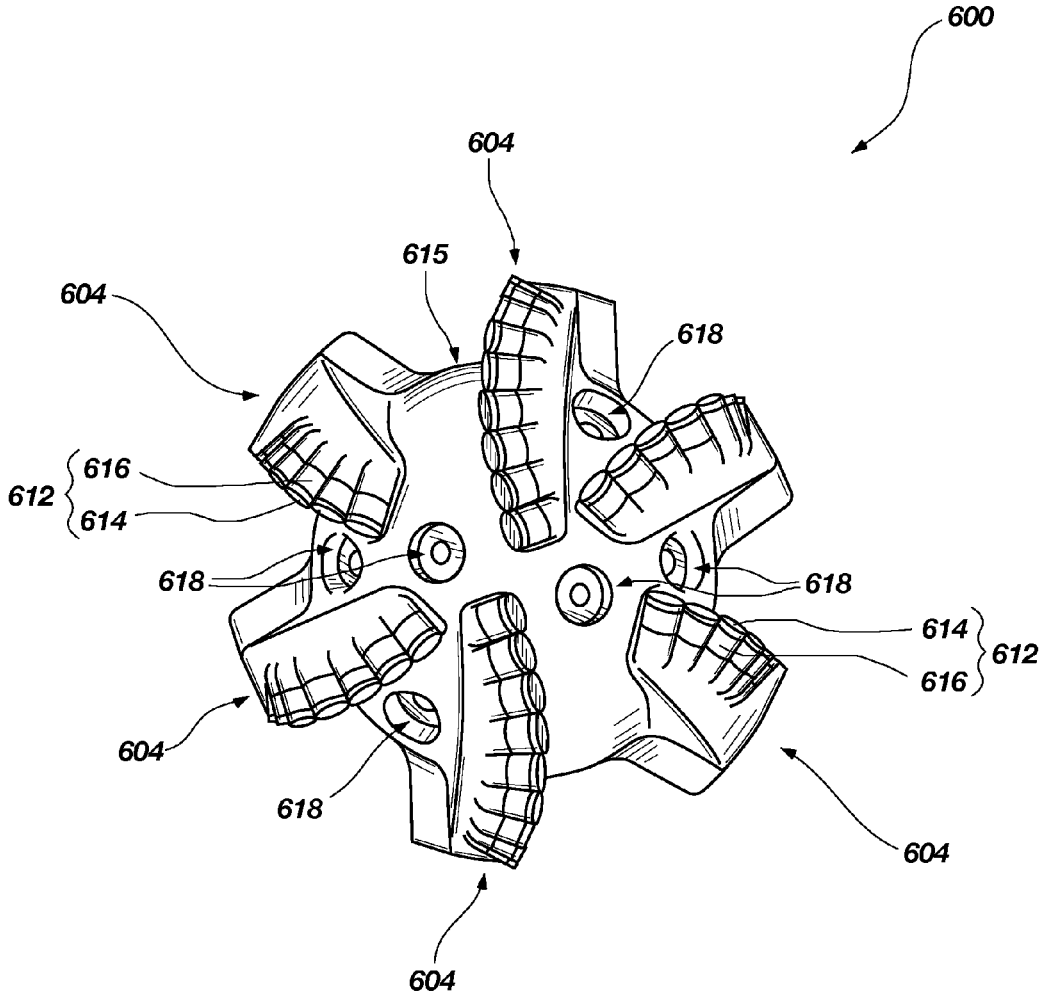
FIG. 7 is a top elevation view of the rotary drill bit shown in FIG. 6.

FIG. 6 is an isometric view and FIG. 7 is a top elevation view of an embodiment of a rotary drill bit 600. The rotary drill bit 600 includes at least one PDC configured according to any of the previously described PDC embodiments, such as the PDC 500 of FIG. 5. The rotary drill bit 600 comprises a bit body 602 that includes radially and longitudinally extending blades 604 having leading faces 606, and a threaded pin connection 608 for connecting the bit body 602 to a drilling string. The bit body 602 defines a leading end structure for drilling into a subterranean formation by rotation about a longitudinal axis 610 and application of weight-on-bit. At least one PDC, configured according to any of the previously described PDC embodiments, may be affixed to bit body 602. With reference to FIG. 7, a plurality of PDCs 612 are secured to the blades 604. For example, each PDC 612 may include a PCD table 614 bonded to a substrate 616. More generally, the PDCs 612 may comprise any PDC disclosed herein, without limitation. In addition, if desired, in some embodiments, a number of the PDCs 612 may be conventional in construction. Also, circumferentially adjacent blades 604 define so-called junk slots 615 therebetween. Additionally, the rotary drill bit 600 includes a plurality of nozzle cavities 618 for communicating drilling fluid from the interior of the rotary drill bit 600 to the superabrasive compacts 612.

FIGS. 6 and 7 merely depict one embodiment of a rotary drill bit that employs at least one PDC fabricated and structured in accordance with the disclosed embodiments, without limitation. The rotary drill bit 600 is used to represent any number of earth-boring tools or drilling tools, including, for example, core bits, roller-cone bits, fixed-cutter bits, eccentric bits, bicenter bits, reamers, reamer wings, or any other downhole tool including superabrasive compacts, without limitation.

The PDCs disclosed herein (e.g., the PDC 500 shown in FIG. 5) may also be utilized in applications other than cutting technology. For example, the disclosed PDC embodiments may be used in wire-drawing dies, bearings, artificial joints, inserts, cutting elements, and heat sinks. Thus, any of the PDCs disclosed herein may be employed in an article of manufacture including at least one superabrasive element or compact.

Thus, the embodiments of PDCs disclosed herein may be used on any apparatus or structure in which at least one conventional PDC is typically used. For example, in one embodiment, a rotor and a stator (i.e., a thrust bearing apparatus) may each include a PDC (e.g., the PDC 500 shown in FIG. 5) according to any of the embodiments disclosed herein and may be operably assembled to a downhole drilling assembly. U.S. Pat. Nos. 4,410,054; 4,560,014; 5,364,192; 5,368,398; and 5,480,233, the disclosure of each of which is incorporated herein, in its entirety, by this reference, disclose subterranean drilling systems within which bearing apparatuses utilizing superabrasive compacts disclosed herein may be incorporated. The embodiments of PDCs disclosed herein may also form all or part of heat sinks, wire dies, bearing elements, cutting elements, cutting inserts (e.g., on a roller cone type drill bit), machining inserts, or any other article of manufacture as known in the art. Other examples of articles of manufacture that may use any of the PDCs disclosed herein are disclosed in U.S. Pat. Nos. 4,811,801; 4,274,900; 4,268,276; 4,468,138; 4,738,322; 4,913,247; 5,016,718; 5,092,687; 5,120,327; 5,135,061; 5,154,245; 5,180,022; 5,460,233; 5,544,713; and 6,793,681, the disclosure of each of which is incorporated herein, in its entirety, by this reference.

While various aspects and embodiments have been disclosed herein, other aspects and embodiments are contemplated. The various aspects and embodiments disclosed herein are for purposes of illustration and are not intended to be limiting. Additionally, the words "including," "having," and variants thereof (e.g., "includes" and "has") as used herein, including the claims, shall have the same meaning as the word "comprising" and variants thereof (e.g., "comprise" and "comprises").

What is claimed is:

1. A method of fabricating polycrystalline diamond, comprising:

(i) providing a plurality of diamond crystals and a metal-solvent catalyst;

(ii) subjecting the plurality of diamond crystals and the metal-solvent catalyst to a first pressure-temperature condition during which carbon is dissolved in the metal-solvent catalyst and the metal-solvent catalyst is at least partially liquefied;

(iii) after act (ii), subjecting the plurality of diamond crystals and the metal-solvent catalyst to a second pressure-temperature condition at which diamond is stable, wherein carbon has a lower solubility in the metal-solvent catalyst at the second pressure-temperature condition than at the first pressure-temperature condition; and (iv) after act (iii), subjecting the plurality of diamond crystals and the metal-solvent catalyst to a third pressure-temperature condition during which carbon is dissolved in the metal-solvent catalyst.

2. The method of claim 1, further comprising:

after act (iv), subjecting the plurality of diamond crystals and the metal-solvent catalyst to a fourth pressure-temperature condition at which diamond is stable, wherein carbon has a lower solubility in the metal-solvent catalyst at the fourth pressure-temperature condition than at the first and third pressure-temperature conditions.

3. The method of claim 1 wherein a first temperature of the first pressure-temperature condition and a third temperature of the third pressure-temperature condition are each greater than a second temperature of the second pressure-temperature condition.

4. The method of claim 1 wherein the first pressure-temperature condition is the substantially the same or different than the third pressure-temperature condition.

5. The method of claim 1 wherein a second pressure of the second pressure-temperature condition is greater than a first pressure of the first pressure-temperature condition and a third pressure of the third pressure-temperature condition.

6. The method of claim 1 wherein at least one of the first or the third pressure-temperature conditions is a graphite-stable pressure-temperature condition.

7. The method of claim 1 wherein at least one of the first or the third pressure-temperature conditions is a diamond-stable pressure-temperature condition.

8. The method of claim 1, further comprising:

changing from the first pressure-temperature condition to the second pressure-temperature condition by decreasing the temperature while maintaining the pressure substantially constant; and changing from the second pressure-temperature condition to the third pressure-temperature condition by increasing the temperature while maintaining the pressure substantially constant.

9. The method of claim 1 wherein providing a plurality of diamond crystals and a metal-solvent catalyst comprises mixing a non-diamond carbon source with the plurality of diamond crystals.

10. The method of claim 9 wherein the non-diamond carbon source is selected from the group consisting of graphite particles, fullerenes, metastable shells of ultra-dispersed diamond particles, and combinations thereof.

11. The method of claim 9, further comprising:

wherein subjecting the plurality of diamond crystals and the metal-solvent catalyst to a first pressure-temperature condition during which carbon is dissolved in the metal-solvent catalyst comprises subjecting the plurality of diamond crystals, the metal-solvent catalyst, and the non-diamond carbon source to the first pressure-temperature condition during which a portion of at least the non-diamond carbon source is dissolved in the metal-solvent catalyst;

wherein subjecting the plurality of diamond crystals and the metal-solvent catalyst to a second pressure-temperature condition at which diamond is stable comprises subjecting the plurality of diamond crystals, the metal-solvent catalyst, and un-dissolved non-diamond carbon source to the second pressure-temperature condition;

wherein subjecting the plurality of diamond crystals and the metal-solvent catalyst to a third pressure-temperature condition during which carbon is dissolved in the metal-solvent catalyst comprises subjecting the metal-solvent catalyst, the plurality of diamond crystals, and the un-dissolved non-diamond carbon source to the third pressure-temperature condition during which at least a portion of the un-dissolved non-diamond carbon source is dissolved in the metal-solvent catalyst; and after act (iv), subjecting the plurality of diamond crystals and the metal-solvent catalyst to a fourth pressure-temperature condition at which diamond is stable.

12. The method of claim 1 wherein the polycrystalline diamond exhibits increased diamond-to-diamond bond density compared to if the plurality of diamond crystals were sintered in the presence of the metal-solvent catalyst only at the second pressure-temperature condition.

13. The method of claim 1 wherein the metal-solvent catalyst is in the form of metal-solvent catalyst particles mixed with the plurality of diamond crystals.

14. The method of claim 1 wherein providing a plurality of diamond crystals and a metal-solvent catalyst comprises positioning the plurality of diamond crystals adjacent to a layer including the metal-solvent catalyst.

15. The method of claim 1 wherein providing a plurality of diamond crystals and a metal-solvent catalyst comprises positioning the plurality of diamond crystals adjacent to a substrate that includes the metal-solvent catalyst therein.

16. The method of claim 15 wherein subjecting the plurality of diamond crystals and the metal-solvent catalyst to a first pressure-temperature condition during which carbon is dissolved in the metal-solvent catalyst comprises infiltrating the plurality of diamond crystals with the metal-solvent catalyst from the substrate.

17. The method of claim 1 wherein the metal-solvent catalyst is selected from the group consisting of iron, nickel, cobalt, and alloys thereof.

* * * * *